US008573985B2

(12) United States Patent
Patwardhan

(10) Patent No.: US 8,573,985 B2
(45) Date of Patent: Nov. 5, 2013

(54) CONTACTORS FOR ELECTRIC VEHICLE CHARGING SYSTEM

(76) Inventor: Satyajit Patwardhan, Fremont, CA (US)

( * ) Notice: Subject to any disclaimer, the term of this patent is extended or adjusted under 35 U.S.C. 154(b) by 65 days.

(21) Appl. No.: 13/413,646

(22) Filed: Mar. 6, 2012

(65) Prior Publication Data

US 2013/0065452 A1 Mar. 14, 2013

Related U.S. Application Data

(60) Provisional application No. 61/449,726, filed on Mar. 7, 2011.

(51) Int. Cl.
*H01R 12/00* (2006.01)

(52) U.S. Cl.
USPC ..... 439/74; 439/951

(58) Field of Classification Search
USPC ..... 439/74, 951, 55
See application file for complete search history.

(56) References Cited

U.S. PATENT DOCUMENTS 4,126,760 A * 11/1978 Gordon ..... 178/18.05
4,203,978 A * 5/1980 Sturm ..... 514/118
5,385,289 A * 1/1995 Bloch et al. ..... 228/103
5,967,297 A * 10/1999 Kaufman et al. ..... 200/241
6,091,038 A * 7/2000 Murphy et al. ..... 200/563
6,707,358 B1 * 3/2004 Massman ..... 335/132
7,307,229 B2 * 12/2007 Bonn et al. ..... 200/61.54
2002/0081909 A1 * 6/2002 Middlehurst et al. ..... 439/699.1
2003/0143876 A1 * 7/2003 Middlehurst et al. ..... 439/79
2010/0244871 A1 * 9/2010 Blair et al. ..... 324/755

* cited by examiner

*Primary Examiner* — Gary F. Paumen

(57) ABSTRACT

The general field of invention is electrical connectors and their conductor geometry. This patent teaches how to make the register-free charge couplers to have self-cleaning ability as well as tolerating operation under dirty environments such as underbelly of cars, while still delivering the requirements imposed by the register-free functionality. Although this invention can benefit many connector designs and applications, it is particularly beneficial when applied to hands free connectors for charging electric vehicles—also known in the industry as the Electric Vehicle Charge Couplers. The specific geometry taught in the patent satisfies the requirements of register-free connectors such as not to be able to short circuit supply conductors, provide at least one drain side conductor for every supply side conductor, permit easy sliding between supply and drain side conductors and provide at least one drain side contact with its centerline to overlap each supply side contact. Additional treads on the contacts provide self-cleaning ability without disturbing the register-free functionality by providing a path for loose dirt and oxides to escape, while the ridges between the grooves break the dirt into small pieces. The groove pitch is adjusted in relation to the sliding distance between the contacts such that every broken down piece of the dirt finds an escape path.

2 Claims, 4 Drawing Sheets

CONTACTORS FOR ELECTRIC VEHICLE CHARGING SYSTEM

CROSS REFERENCE TO RELATED APPLICATION

Figure 1:
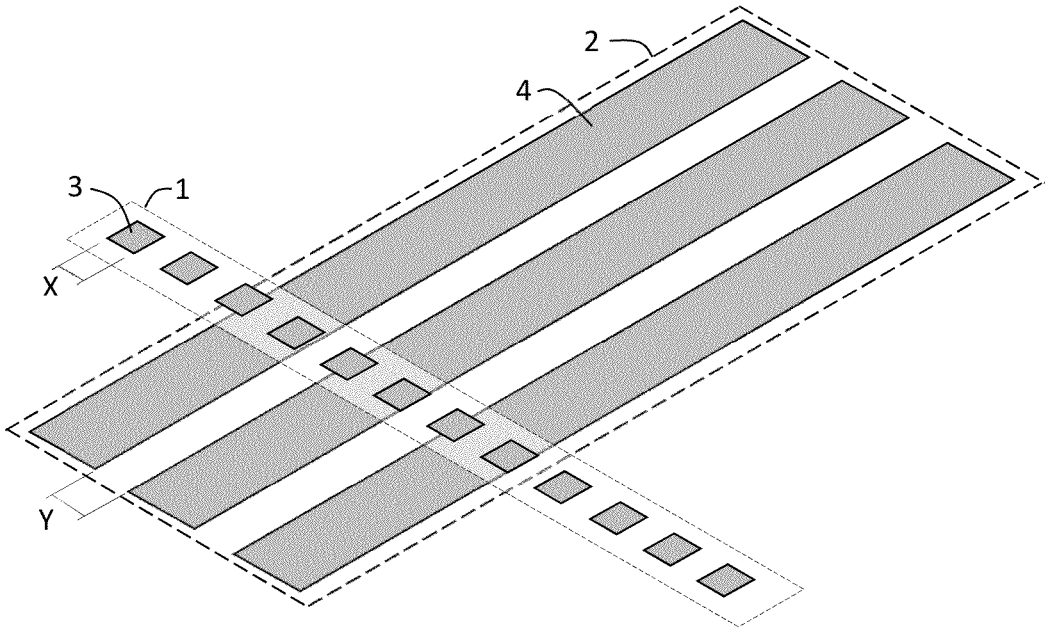

This application the claims the same priority as the previously filed provisional patent application No. 61/449,726, titles "Contactors for Electric Charging System", which is incorporated herein in its entirety by reference.

FIELD OF THE INVENTION

The general field of invention is electrical connectors and their contactors. This field is represented in the U.S. Patent class 200 and several of its sub classes such as 200/239, 200/242, 200/252, 200/253, 200/253.1 and 200/254. Additionally the class 191/62 also relates to the field of this invention. Although this invention can benefit many connector and contactor designs, it is particularly beneficial for hands free connectors for charging electric vehicles—also known in the industry as the Electric Vehicle Charge Couplers.

PRIOR ART RELATED TO THE INVENTION

A previous U.S. patent application Ser. No. 12/168,137, identifies a class of electric connectors—register-free charge couplers, that do not require registration of the two sides of the connector, yet guarantee connectivity of multiple conductive channels over a wide range of relative positions and orientations of the two sides of the connector, thus permitting—for example, an electric vehicle to park at an arbitrary relative position with respect to the parking spot and yet be able to establish charging connections to the car. This is in sharp contrast with the traditional electric connectors whose two sides are mechanically guided to follow a precise relative position and orientation while mating. This particular distinction makes it particularly difficult and un-obvious to implement some of the well-known reliability features commonly found under U.S. Patent class 200 for traditional electrical connectors. This patent teaches how to make the register-free charge couplers to have self-cleaning ability as well as tolerating operation under dirty environments such as underbelly of cars, while still delivering the requirements imposed by the register-free functionality.

The patents from the class 200/239 and 200/242 describe connectors where the two mating parts of the connector mate in a predefined orientation with respect to each other. Furthermore the patents in these classes describe contactors making contact in a "butt joint". In particular, U.S. Pat. No. 6,707,358 and U.S. Pat. No. 5,967,297 describe connectors where the self-cleaning of the contacts is achieved by relative sliding of the contacts. In the present invention—which addresses the register-free connectors, the contacts from the two sides of the connector end up meeting each other is any arbitrary relationship. A subsequent sliding may bring several contacts in and out of connection with respect to each other. Hence the teaching of U.S. Pat. No. 6,707,358, U.S. Pat. No. 5,967,297 are not applicable and neither do they tech how to fashion the contacts to allow for rather random relative sliding and positioning.

The patents from the class 200/252, 200/253 describe connectors where two mating parts of the connector mate in a predefined orientation with respect to each other. Furthermore the patents in these classes describe contactors making a "sliding" contact. In particular U.S. Pat. No. 6,091,038 and U.S. Pat. No. 7,307,229 describe patents where mating connectors slide with respect to each other, but do not go in and out of contact once mated. Secondly, the features such as knife edge can be located at a predefined location and still be effective. These teaching do not provide any clue in fashioning connectors for a register-free connector—which is the subject matter of this invention.

The patents from the class 200/253.1, 200/254 describe plug-and-socket and knife-and-clip configurations respectively. These configurations primarily depend on the precise relative position of the two mating parts of the connector. Consequently the teachings of these patents are not translatable into a register-free connector.

DETAILED DESCRIPTION OF THE INVENTION

A previous U.S. patent application Ser. No. 12/168,137, identifies a class of conductive charge couplers that do not require registration of the two sides of the charge coupler, yet guarantee connectivity of multiple conductive channels over a wide range of relative positions and orientations of the two sides of the charge coupler, thus permitting an electric vehicle to park at an arbitrary relative position to the parking spot, yet be able to establish charging connections to the car. A particular conductor shape is preferred for this class of charge couplers.

In the following description, different objects and features are identified first with numbers, followed by small case letter as needed to identify a specific rendition of the said feature or object. Different dimensions that are critical for the functionality are identified by upper case letters and in some cases followed by numbers to group together similar dimensions.

Figure 2:
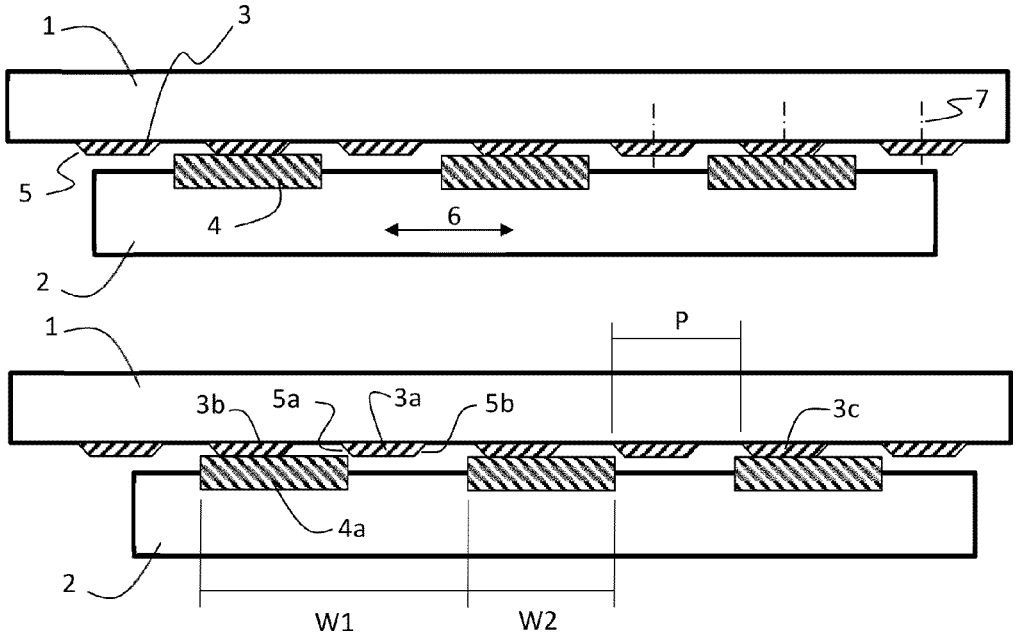

FIG. 1. Shows a connector, comprising of two components 1 and 2 respectively. The component 1 carries a series of similarly shaped conductors 3 and the component 2 carries three similarly shaped conductors 4. FIG. 2 shows these conductors in two of their mating positions. The linear dimension X of conductors 3, and the separation Y between neighboring 4 conductors is such that none of the conductors 3 will straddle across neighboring 4 conductors, such that none of the conductors 4 will be shorted to each other.

FIG. 2 shows only two of infinitely many relative positions between the components 1 and 2. Additionally, 1 and 2 are allowed to move with respect to each other while in contact with each other—to at least partially fulfill the requirements for achieving self-cleaning. This is achieved by the chamfer 5. When 2 moves relative to 1 in the direction 6, carrying 4 with it, the conductor 4*a*—for example, will first ride along 5*a* and then make the full contact with 3*a*. Similarly 4*a* will ride along 5*b* as it moves away from 3*a*.

The widths W1 and W2 of conductors 4—shown in FIG. 2, as well as the pitch P of the conductors 3 is set such that at least one of the conductors 3 mates with each of the conductors 4.

As shown in FIG. 2, at least one or more of the 3 conductors will mate with each of the 4 conductors. In order to avoid edge contact, at least one of these contacts should have its centerline of mating surface area 7 to be inside the boundaries W2 of the corresponding contact 4.

As seen in FIG. 2, the conductors between 3*b* and 3*c* end up finding a mating connector from the connector 2. However the exact polarity of each of the conductors between 3*b* and 3*c* is unknown until the two sides 1 and 2 mate. This needs that at least these many conductors as there are between 3*b* and 3*c* need to be provided with an independent switch which can connect each of these conductors to the desired output terminal. This count will be minimum when the connectors 1 and 2 are disposed perpendicular to each other. However the count increases when the connectors 1 and 2 are not perpendicular to each other.

Figure 3:
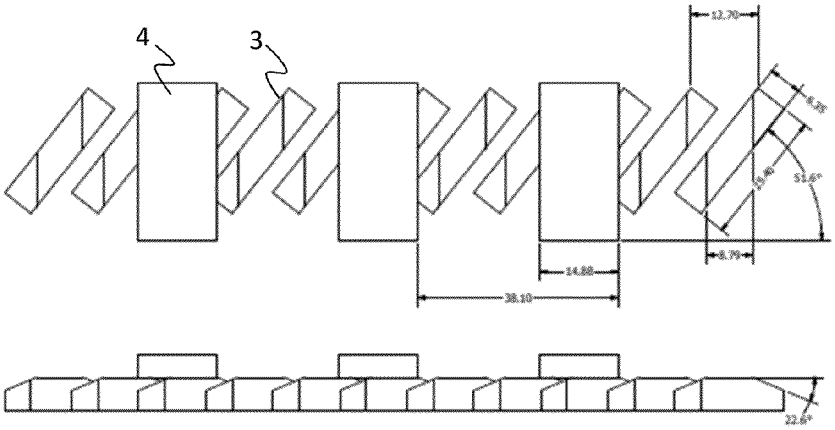
Figure 4:
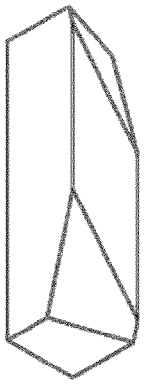

FIG. 3 shows a specific geometry along with a specific set of dimensions that satisfy all the constrains: (i) no short circuit between neighboring 4 connectors, (ii) ease of sliding 1 with respect to 2 in mating position, (iii) providing at least one of the 3 conductors for every 4 conductor, (iv) at least one of the 3 conductors mating with each of the 4 conductors has its center of mating surface to be within the extents of corresponding conductor 4 and (v) minimizing the total number of 3 conductors overlapping—either fully or partially the connector 2. The example in FIG. 4 is provided just to establish that at least one configuration of the conductors exists that can satisfy all the requirements. However an expert in the field of conductors and two dimensional geometry can easily realize that there are many such configurations that satisfy the five requirements. All these alternate configurations are considered as being taught by this patent.

Figure 5:
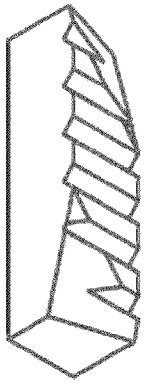
Figure 6:
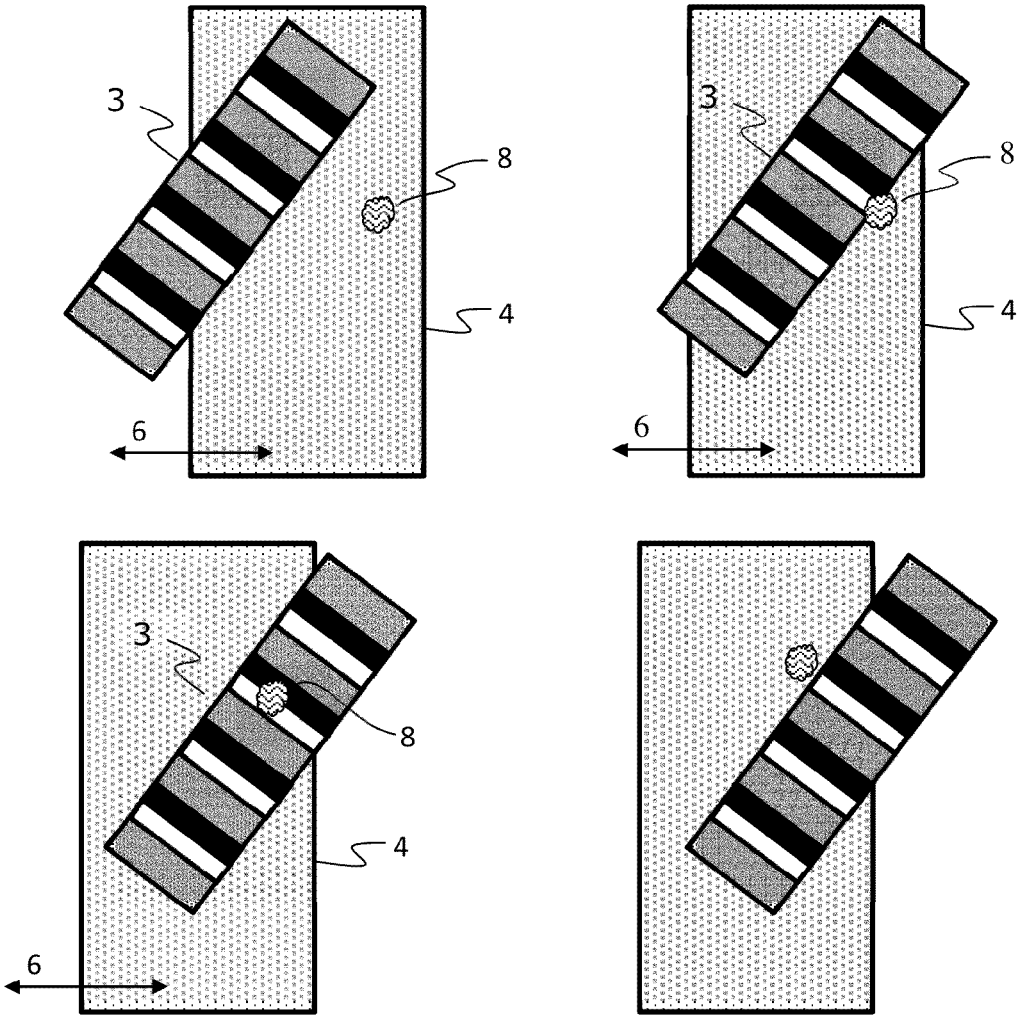
Figure 7:
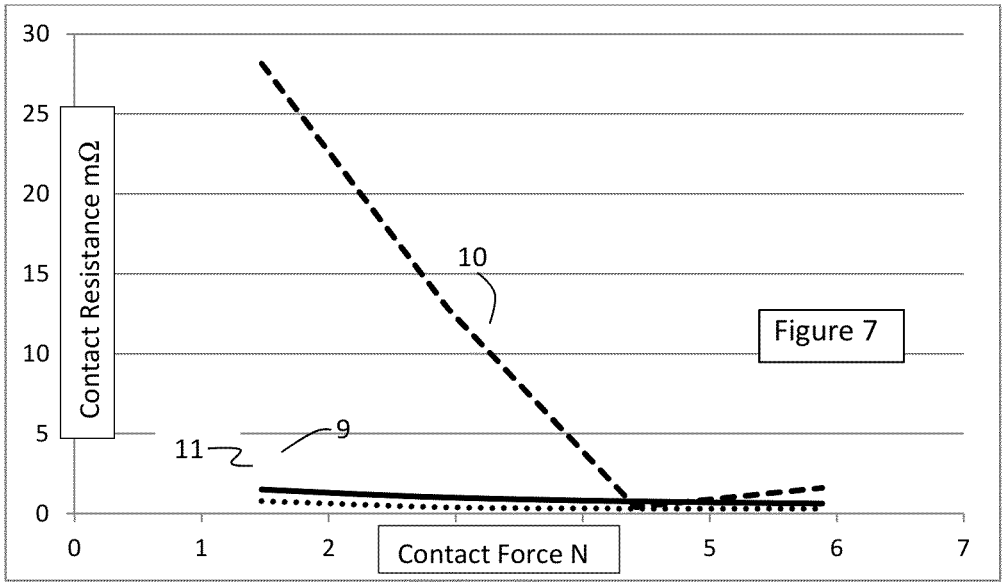

FIG. 4 shows an individual conductor 3, and FIG. 5 shows an identical conductor, except with a series of grooves cut along its mating surface. These grooves do not disturb any of the basic functions of conductor 3. However they provide a path of loose dirt and non-conductive chemical compounds to escape out of the interface region. These grooves function much like treads in a tire. In order for the interaction between the dirt and the grooves to work, the dirt 8 (See FIG. 6) needs to be broken into pieces no bigger than the groove. This is automatically achieved by the fact that each pair of grooves have a ridge between them, which ends up breaking the dirt 8 into pieces smaller than the distance between the ridges. Next, a groove need to appear within the relative distance travelled during sliding. This means that the pitch Q of grooves has to be smaller than the sliding distance S between the two conductors 3 and 4. FIG. 7 is a graph of contact resistance vs. the contact force for different conductor geometries, which indicate the advantages of conductor trades. The conductor with trades—graph, achieves consistently low contact resistance independent of the contact force, while conductors without grooves—graph 10, needs large interaction force to deliver good contact. Graph 11 represents new contacts which tend to deliver good contact for all levels of contact force.

What is claimed is:

1. A register-free connector comprising of a first connector half and a second connector half, a group of first conductors, each with a substantially cuboid shape and arranged in an evenly spaced first linear arrangement on the first connector half with the longer edge of the cuboid at an acute angle to the first line of arrangement, a chamfer on two opposite corners of the first connectors that are nearest to the neighboring connectors on each side of every first connector, the pitch of the first connectors being one unit, a group of second conductors with a substantially cuboid shape and disposed on the second connector half in an evenly spaced second linear arrangement with a pitch of three units, the width of each of the second conductors along the second line of arrangement to be greater than one unit, the total extent of each of the first conductors to be less than the gap between two neighboring second conductors.

2. A register free connector as described in claim 1 with each of the first conductors to have periodic grooves on their mating surface that are parallel to each other and are at an acute angle to the first line of arrangement.

* * * * *